US006193678B1

(12) United States Patent
Brannon

(10) Patent No.: US 6,193,678 B1
(45) Date of Patent: Feb. 27, 2001

(54) MASSAGING SYSTEM

(76) Inventor: Sammy S. Brannon, Box 385, Buchanan, GA (US) 30113

( * ) Notice: Subject to any disclaimer, the term of this patent is extended or adjusted under 35 U.S.C. 154(b) by 0 days.

(21) Appl. No.: 09/105,885

(22) Filed: Jun. 26, 1998

(51) Int. Cl.[7] ..... A61H 1/00; A61H 1/02; A61H 5/00

(52) U.S. Cl. ..... 601/15; 601/70; 601/79

(58) Field of Search ..... 601/15, 18, 50, 601/52, 54, 56, 57, 59, 60, 79, 134, 70; 607/108, 114, 115, 96; 2/102; 482/105; 602/60–62

(56) References Cited

U.S. PATENT DOCUMENTS

| | | | | |
|---|---|---|---|---|
| 3,053,250 | * | 9/1962 | Stubbs | 601/79 |
| 3,310,050 | * | 3/1967 | Goldfarb | 601/79 |
| 3,483,862 | | 12/1969 | Takeuchi | 128/33 |
| 3,950,789 | * | 4/1976 | Konz et al. | 607/108 |
| 4,057,046 | | 11/1977 | Kawaguchi | 128/24 R |
| 4,086,920 | | 5/1978 | Miniere | 128/24 R |
| 4,186,732 | | 2/1980 | Christoffel | 128/24 R |
| 4,382,302 | * | 5/1983 | Watson | 2/102 |
| 4,481,937 | | 11/1984 | Arkans | 128/24 R |
| 4,696,066 | * | 9/1987 | Ball et al. | 2/102 |
| 4,979,502 | * | 12/1990 | Hunt | 602/1 |
| 5,020,517 | * | 6/1991 | Foster, Jr. et al. | 601/70 X |
| 5,302,806 | * | 4/1994 | Simmons et al. | 607/108 |
| 5,370,603 | | 12/1994 | Newman | 601/41 |
| 5,486,156 | * | 1/1996 | Takach | 607/70 |
| 5,545,125 | * | 8/1996 | Tseng | 601/70 X |
| 5,902,256 | * | 5/1999 | Benaron | 601/15 |

* cited by examiner

*Primary Examiner*—Stephen R. Crow
*Assistant Examiner*—Denise Pothier
(74) *Attorney, Agent, or Firm*—Joseph N. Breaux

(57) ABSTRACT

A massaging system that includes a mechanism for positioning and holding vibrating and heating units onto the body at user selected locations. The massaging system includes a vest unit including a hook and pile covered interior surface and at least one user-adjustable, massaging and heat unit compression band attached to an exterior of the vest unit; at least one heating pad unit including a heating pad connecting jack, hook and pile fastener strips on a first exterior surface of the heating pad exterior that are companionate with the hook and pile covered interior surface of the vest unit, and a vibration unit hook and pile fastener attaching section provided on a second exterior surface that is the same hook and pile material as the hook and pile covered interior surface of the vest unit; and at least one vibration unit having a vibration unit connecting jack and hook and pile fastener strips on the exterior thereof that are companionate with the hook and pile covered interior surface of the vest unit.

16 Claims, 3 Drawing Sheets

MASSAGING SYSTEM

TECHNICAL FIELD

The present invention relates to massaging devices and more particularly to a massaging system that includes a vest unit including a hook and pile covered interior surface and at least one user-adjustable, massaging and heat unit compression band attached to an exterior of the vest unit; at least one heating pad unit including a heating pad connecting jack, hook and pile fastener strips on a first exterior surface of the heating pad exterior that are companionate with the hook and pile covered interior surface of the vest unit, and a vibration unit hook and pile fastener attaching section provided on a second exterior surface that is the same hook and pile material as the hook and pile covered interior surface of the vest unit; at least one vibration unit having a vibration unit connecting jack and hook and pile fastener strips on the exterior thereof that are companionate with the hook and pile covered interior surface of the vest unit; a vehicle cigarette lighter power adapter with an adapter control unit connecting jack; a battery pack with a battery pack control unit connecting jack; an AC/DC converter unit with a converter unit control unit jack; and a control unit including a control circuit housed within a control housing and in electrical connection with a control unit power input plug connectable to the adapter control unit connecting jack, the battery pack control unit connecting jack, and the converter unit control unit jack; a serial mode selector switch, a continuous mode selector switch, a back-and-forth mode selector switch, a vibration speed variable position control switch, a heating pad on/off switch, a heating pad heat intensity variable position heat control switch, and a wiring harness including a cable in connection between the control circuit and at least one vibration unit connecting plug that is electrically and mechanically connectable to the vibration unit connecting jack and at least one heating pad connecting plug that is electrically and mechanically connectable to the heating pad connecting jack.

BACKGROUND ART

Most people have spots or locations on the body that benefit most from massaging and the application of heat. Although individuals have these spots it is often difficult to have massaging vibrations and/or heat applied to these spots with conventional massaging devices and heating pads. It would be a benefit, therefore, to have a massaging system that included a mechanism for allowing a user to position vibrating and heating units onto the body at user selected locations and to hold the vibrating and heating units in place. It would be a further benefit if the vibrating units and heating units could be repositioned as required for more than one user.

GENERAL SUMMARY DISCUSSION OF INVENTION

It is thus an object of the invention to provide a massaging system that includes a mechanism for positioning and holding vibrating and heating units onto the body at user selected locations.

It is a further object of the invention to provide a massaging system that includes user positionable vibrating and heating units that are repositionable as needed.

It is a still further object of the invention to provide a massaging system that includes a vest unit including a hook and pile covered interior surface and at least one user-adjustable, massaging and heat unit compression band attached to an exterior of the vest unit; at least one heating pad unit including a heating pad connecting jack, hook and pile fastener strips on a first exterior surface of the heating pad exterior that are companionate with the hook and pile covered interior surface of the vest unit, and a vibration unit hook and pile fastener attaching section provided on a second exterior surface that is the same hook and pile material as the hook and pile covered interior surface of the vest unit; at least one vibration unit having a vibration unit connecting jack and hook and pile fastener strips on the exterior thereof that are companionate with the hook and pile covered interior surface of the vest unit; a vehicle cigarette lighter power adapter with an adapter control unit connecting jack; a battery pack with a battery pack control unit connecting jack; an AC/DC converter unit with a converter unit control unit jack; and a control unit including a control circuit housed within a control housing and in electrical connection with a control unit power input plug connectable to the adapter control unit connecting jack, the battery pack control unit connecting jack, and the converter unit control unit jack; a serial mode selector switch, a continuous mode selector switch, a back-and-forth mode selector switch, a vibration speed variable position control switch, a heating pad on/off switch, a heating pad heat intensity variable position heat control switch, and a wiring harness including a cable in connection between the control circuit and at least one vibration unit connecting plug that is electrically and mechanically connectable to the vibration unit connecting jack and at least one heating pad connecting plug that is electrically and mechanically connectable to the heating pad connecting jack.

It is a still further object of the invention to provide a massaging system that accomplishes some or all of the above objects in combination.

Accordingly, a massaging system is provided. The massaging system includes a vest unit including a hook and pile covered interior surface and at least one user-adjustable, massaging and heat unit compression band attached to an exterior of the vest unit; at least one heating pad unit including a heating pad connecting jack, hook and pile fastener strips on a first exterior surface of the heating pad exterior that are companionate with the hook and pile covered interior surface of the vest unit, and a vibration unit hook and pile fastener attaching section provided on a second exterior surface that is the same hook and pile material as the hook and pile covered interior surface of the vest unit; at least one vibration unit having a vibration unit connecting jack and hook and pile fastener strips on the exterior thereof that are companionate with the hook and pile covered interior surface of the vest unit; a vehicle cigarette lighter power adapter with an adapter control unit connecting jack; a battery pack with a battery pack control unit connecting jack; an AC/DC converter unit with a converter unit control unit jack; and a control unit including a control circuit housed within a control housing and in electrical connection with a control unit power input plug connectable to the adapter control unit connecting jack, the battery pack control unit connecting jack, and the converter unit control unit jack; a serial mode selector switch, a continuous mode selector switch, a back-and-forth mode selector switch, a vibration speed variable position control switch, a heating pad on/off switch, a heating pad heat intensity variable position heat control switch, and a wiring harness including a cable in connection between the control circuit and at least one vibration unit connecting plug that is electrically and mechanically connectable to the vibration unit connecting jack and at least one heating pad connecting plug that is electrically and mechanically connectable to the heating pad connecting jack. The user-adjustable, massaging and heat unit compression band is preferably constructed from an elastomeric material.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
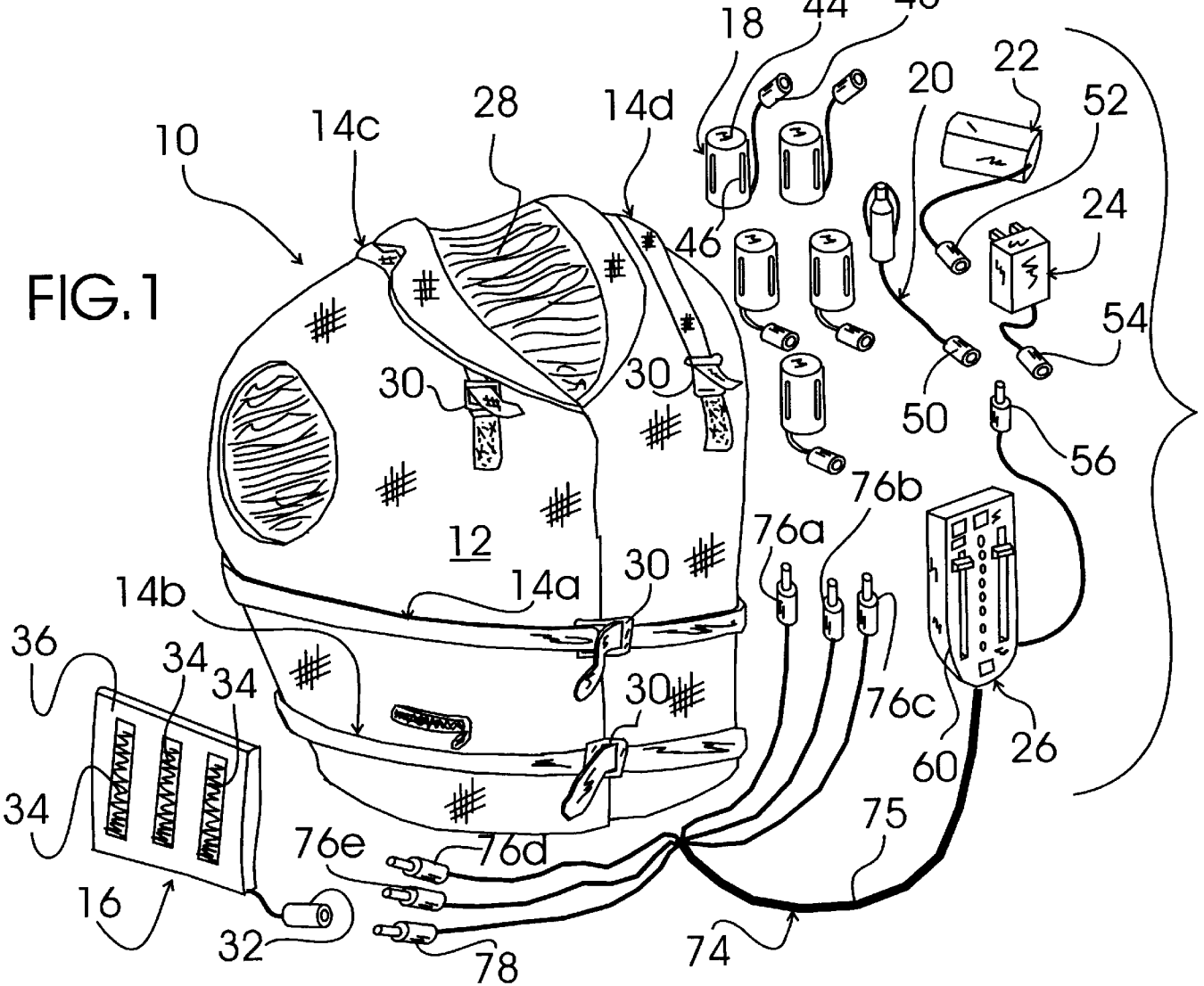
FIG. 1 is a perspective view of an exemplary embodiment of the massaging system of the present invention showing an exemplary vest unit including the hook and pile covered interior surface and four exemplary elastomeric, user-adjustable, massaging and heat unit compression bands attached to the exterior of the vest unit; one heating pad unit including the hook and pile fastener strips on a first side of the heating pad exterior and the pad connecting jack; five exemplary vibration units each having a number of hook and pile fastener strips on the exterior thereof and a vibration unit connecting jack; a vehicle cigarette lighter power adapter with an adapter control unit connecting jack; a battery pack with a battery pack control unit connecting jack; an AC/DC converter unit with a converter unit control unit jack; and an exemplary control unit including a control circuit housed within a control housing, a control unit power input plug, a serial mode selector switch, a continuous mode selector switch, a back-and-forth mode selector switch, a vibration speed variable position control switch, a heating pad on/off switch, a heating pad heat intensity variable position heat control switch, and a wiring harness including a cable in connection between the control circuit and five vibration unit connecting plugs and a heating pad connecting plug.

FIG. 1 shows an exemplary embodiment of the massaging system of the present invention generally designated 10. Massaging system 10 includes a fabric vest unit, generally designated 12; four elastic, user-adjustable, massaging and heat unit compression bands, generally designated 14*a–d*; a heating pad unit, generally designated 16; five identical vibration units, generally designated 18; a vehicle cigarette lighter power adapter, generally designated 20; a battery pack, generally designated 22; an AC/DC converter unit, generally designated 24; and a control unit, generally designated 26.

Vest unit 12 is of conventional sewn fabric construction and has an interior surface 28 entirely covered with hook and pile fastener material. Two of the four user-adjustable, massaging and heat unit compression bands 14*a*,14*b* are stitched to the exterior of the torso covering area of vest unit 12. The remaining two user-adjustable, massaging and heat unit compression bands 14*c*,14*d* are stitched to the shoulder covering areas of the exterior of vest unit 12. Each of the four user-adjustable, massaging and heat unit compression bands 14*a–d* is adjustable in length with a buckle assembly 30.

Figure 2:
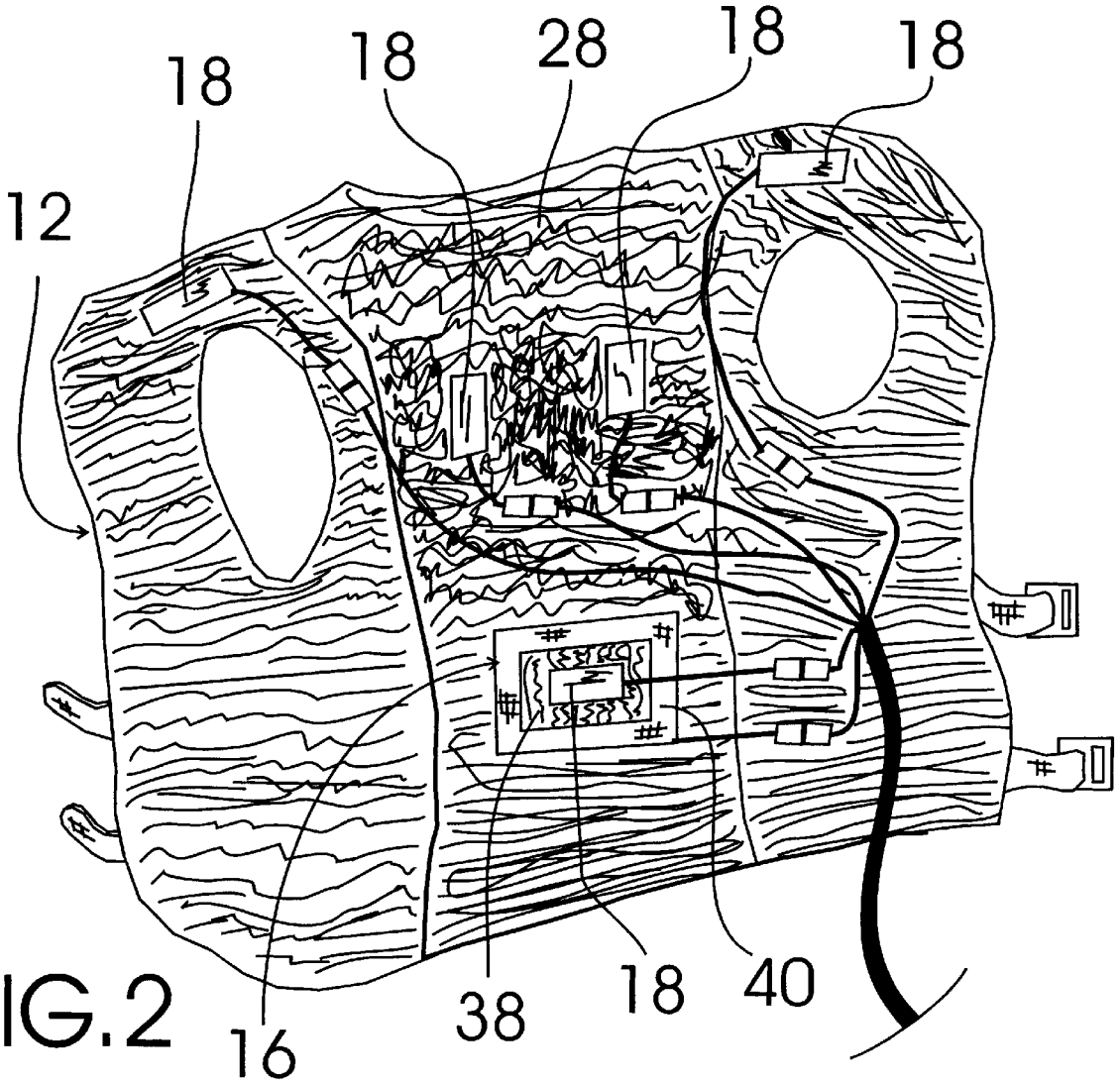
FIG. 2 is a plan view showing the interior surface of the vest unit of FIG. 1 showing the hook and pile covered interior with four of the five vibration units attached directly to the interior surface, the first side of the heating pad exterior surface attached directly to the interior surface, and one of the five vibration units attached to a vibration unit hook and pile fastener attaching section provided on a second exterior surface of the heating pad unit.

Heating pad unit 16 is a conventional resistance element heating pad having a heating pad connecting jack 32, hook and pile fastener strips 34 on a first exterior surface 36, and a vibration unit hook and pile fastener attaching section 38 (FIG. 2) provided on a second exterior surface 40 (FIG. 2). Hook and pile fastener strips 34 are companionately attachable with the hook and pile covered interior surface 28 of vest unit 12. Vibration unit hook and pile fastener attaching section 38 is the same hook and pile material as hook and pile covered interior surface 28 of vest unit 12.

Each of the five identical vibration units 18 has a conventional electric motor vibration element housed within a cylindrical housing 44, a number of hook and pile fastener strips 46 on the exterior of housing 44, and a vibration unit connecting jack 48. Hook and pile fastener strips 46 are companionately attachable to the hook and pile covered interior surface 28 of vest unit 12 and vibration unit hook and pile fastener attaching section 38 (FIG. 2) on second exterior surface 40 (FIG. 2) of heating pad 16.

Figure 3:
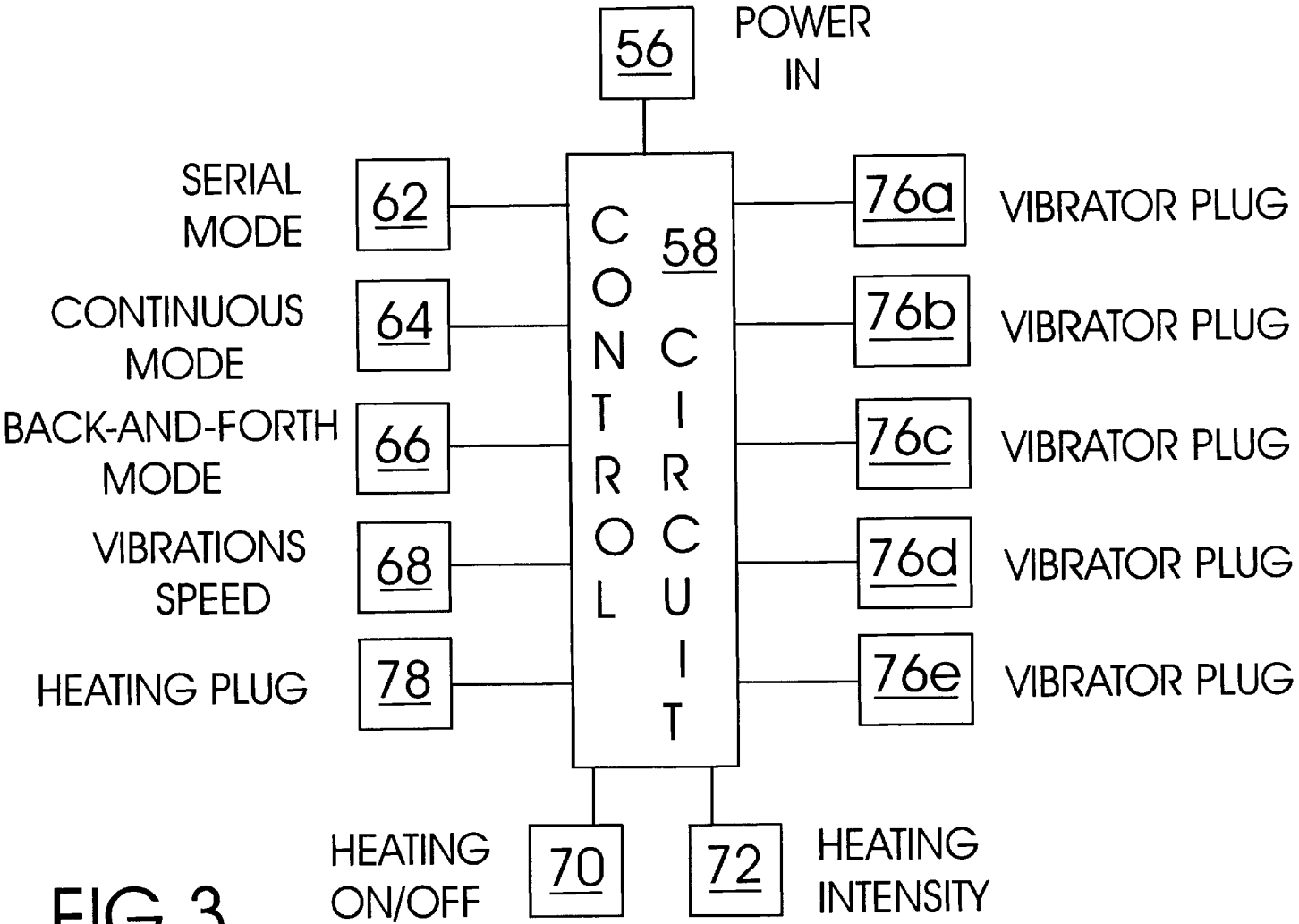
FIG. 3 is a schematic diagram showing the control circuit in connection with the control unit power input plug, the serial mode selector momentary contact switch, the continuous mode selector momentary contact switch, the back-and-forth mode selector momentary contact switch, the vibration speed variable position control switch; the heating pad on/off two-position switch, the heating pad heat intensity variable position heat control switch, and the wiring harness including the five vibration unit connecting plugs and the heating pad connecting plug.

Vehicle cigarette lighter power adapter 20 includes an adapter control unit connecting jack 50. Battery pack 22 includes a battery pack control unit connecting jack 52. AC/DC converter unit 24 includes a converter unit control unit jack 54. Adapter control unit connecting jack 50, battery pack control unit connecting jack 52, and converter unit control unit jack 54 are each electrically and mechanically connectable to a control unit power input plug 56 that, with reference now to FIG. 3, supplies power to a control circuit 58 housed within a control housing 60 (FIG. 1). Control circuit 58 is a conventional massager controller circuit that is in electrical connection with a serial mode selector momentary contact switch 62, a continuous mode selector momentary contact switch 64, a back-and-forth mode selector momentary contact switch 66, a vibration speed variable position control switch 68, a two-position heating pad on/off switch 70, a heating pad heat intensity variable position heat control switch 72, and a wiring harness, generally designated 74 (FIG. 1) including a cable 75 (FIG. 1) in connection between control circuit 58 and five vibration unit connecting plugs 76*a–e* and a heating pad connecting plug 78. Control circuit 58 is programmed such that: a) depressing serial mode selector momentary contact switch 62 causes control circuit 58 to serially energize vibration unit connecting plugs 76*a–e* one at a time and repeat until either continuous mode selector momentary contact switch 64 or back-and-forth mode selector momentary contact switch 66 is depressed; b) depressing continuous mode selector momentary contact switch 66 causes control circuit 58 to energize vibration unit connecting plugs 76*a–e* all at the same time until either serial mode selector momentary contact switch 62 or back-and-forth mode selector momentary contact switch 66 is depressed; and c) depressing back-and-forth mode selector momentary contact switch 68 causes control circuit 58 to serially energize vibration unit connecting plugs 76*a–e* in a first direction one at a time from 76*a* to 76*e* then reversing to a second direction to serially energize vibration unit connecting plugs 76*a–e* one at a time in the second direction from 76*e* to 76*a* and then repeating until either serial mode selector momentary contact switch 62 or continuous mode selector momentary contact switch 64 is depressed.

With reference back to FIG. 2, prior to use, the user positions vibration units 18 and heating pad 16 at desired location on interior 28 of vest unit 12. Vest unit 12 is then donned and, referring to FIG. 1, user-adjustable, massaging and heat unit compression bands 14*a–d* adjusted as desired. The user can then select the operating mode, vibration speed and heat intensity using control unit 26.

It can be seen from the preceding description that a massaging system has been provided that includes a mechanism for positioning and holding vibrating and heating units onto the body at user selected locations; that includes user positionable vibrating and heating units that are repositionable as needed; and that includes a vest unit including a hook and pile covered interior surface and at least one user-adjustable, massaging and heat unit compression band attached to an exterior of the vest unit; at least one heating pad unit including a heating pad connecting jack, hook and pile fastener strips on a first exterior surface of the heating pad exterior that are companionate with the hook and pile covered interior surface of the vest unit, and a vibration unit hook and pile fastener attaching section provided on a second exterior surface that is the same hook and pile material as the hook and pile covered interior surface of the vest unit; at least one vibration unit having a vibration unit connecting jack and hook and pile fastener strips on the exterior thereof that are companionate with the hook and pile covered interior surface of the vest unit; a vehicle cigarette lighter power adapter with an adapter control unit connecting jack; a battery pack with a battery pack control unit connecting jack; an AC/DC converter unit with a converter unit control unit jack; and a control unit including a control circuit housed within a control housing and in electrical connection with a control unit power input plug connectable to the adapter control unit connecting jack, the battery pack control unit connecting jack, and the converter unit control unit jack; a serial mode selector switch, a continuous mode selector switch, a back-and-forth mode selector switch, a vibration speed variable position control switch, a heating pad on/off switch, a heating pad heat intensity variable position heat control switch, and a wiring harness including a cable in connection between the control circuit and at least one vibration unit connecting plug that is electrically and mechanically connectable to the vibration unit connecting jack and at least one heating pad connecting plug that is electrically and mechanically connectable to the heating pad connecting jack.

It is noted that the embodiment of the massaging system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A massaging system comprising:

a vest unit including a hook and pile covered interior surface entirely covered with the hook and pile fastener material and at least one user-adjustable, massaging and heat unit compression band attached to an exterior of the vest unit;

at least one heating pad unit including a heating pad connecting jack, hook and pile fastener strips on a first exterior surface of the heating pad exterior that are complementary with the hook and pile covered interior surface of the vest unit, and a vibration unit hook and pile fastener attaching section provided on a second exterior surface that is the same hook and pile material as the hook and pile covered interior surface of the vest unit;

multiple vibration units, each vibration unit having a vibration unit connecting jack and hook and pile fastener strips on the exterior thereof that are complementary with the hook and pile covered interior surface of the vest unit; and a control unit including a control circuit housed within a control housing, the control circuit being in electrical connection with a control unit power input plug connectable to a power source; a serial mode selector switch, a continuous mode selector switch, a back-and-forth mode selector switch, a vibration speed variable position control switch, a heating pad on/off switch, a heating pad heat intensity variable position heat control switch, and a wiring harness including a cable in connection between the control circuit and multiple vibration unit connecting plus that are each electrically and mechanically connectable to the vibration unit connecting jack of one of the multiple vibration units and at least one heating pad connecting plug that is electrically and mechanically connectable to the heating pad connecting jack;

said control circuit being programmed such that:

operating the serial mode selector switch causes the control circuit to serially energize vibration unit connecting plugs one at a time and repeat until either the continuous mode selector switch or the back-and-forth mode selector switch is operated;

depressing the continuous mode selector switch causes the control circuit to energize vibration unit connecting plugs all at the same time until either the serial mode selector switch or the back-and-forth mode selector switch is operated; and depressing the back-and-forth mode selector switch causes the control circuit to serially energize the vibration unit connecting plugs in a first direction one at a time then reversing to a second direction to serially energize the vibration unit connecting plugs one at a time in the second direction and then repeating until either the serial mode selector switch or the continuous mode selector switch is operated.

2. The massaging system of claim 1, wherein:

said at least one user-adjustable, massaging and heat unit compression band is constructed from elastomeric material.

3. The massaging system of claim 2, wherein:

said massaging system further includes a battery pack with a battery pack control unit connecting jack; and said control unit power input plug is connectable with said battery pack control unit connecting jack.

4. The massaging system of claim 3 wherein:

said massaging system further includes an AC/DC converter unit with a converter unit control unit jack; and said control unit power input plug is connectable to said converter unit control unit jack.

5. The massaging system of claim 4 wherein:

said massaging system further includes a vehicle cigarette lighter power adapter with an adapter control unit connecting jack; and said control unit power input plug is connectable with said adapter control unit connecting jack.

6. The massaging system of claim 3 wherein:

said massaging system further includes a vehicle cigarette lighter power adapter with an adapter control unit connecting jack; and said control unit power input plug is connectable with said adapter control unit connecting jack.

7. The massaging system of claim 2 wherein:

said massaging system further includes an AC/DC converter unit with a converter unit control unit jack; and said control unit power input plug is connectable to said converter unit control unit jack.

8. The massaging system of claim 7 wherein:

said massaging system further includes a vehicle cigarette lighter power adapter with an adapter control unit connecting jack; and said control unit power input plug is connectable with said adapter control unit connecting jack.

9. The massaging system of claim 2 wherein:

said massaging system further includes a vehicle cigarette lighter power adapter with an adapter control unit connecting jack; and said control unit power input plug is connectable with said adapter control unit connecting jack.

10. The massaging system of claim 1, wherein:

said massaging system further includes a battery pack with a battery pack control unit connecting jack; and said control unit power input plug is connectable with said battery pack control unit connecting jack.

11. The massaging system of claim 10 wherein:

said massaging system further includes an AC/DC converter unit with a converter unit control unit jack; and said control unit power input plug is connectable to said converter unit control unit jack.

12. The massaging system of claim 11 wherein:

said massaging system further includes a vehicle cigarette lighter power adapter with an adapter control unit connecting jack; and said control unit power input plug is connectable with said adapter control unit connecting jack.

13. The massaging system of claim 10 wherein:

said massaging system further includes a vehicle cigarette lighter power adapter with an adapter control unit connecting jack; and said control unit power input plug is connectable with said adapter control unit connecting jack.

14. The massaging system of claim 1 wherein:

said massaging system further includes an AC/DC converter unit with a converter unit control unit jack; and said control unit power input plug is connectable to said converter unit control unit jack.

15. The massaging system of claim 14 wherein:

said massaging system further includes a vehicle cigarette lighter power adapter with an adapter control unit connecting jack; and said control unit power input plug is connectable with said adapter control unit connecting jack.

16. The massaging system of claim 1 wherein:

said massaging system further includes a vehicle cigarette lighter power adapter with an adapter control unit connecting jack; and said control unit power input plug is connectable with said adapter control unit connecting jack.

* * * * *